United States Patent [19]

Southgate

[11] 4,250,496

[45] Feb. 10, 1981

[54] AUDIO CHIME-SIGNAL GENERATING CIRCUIT

[75] Inventor: Roger E. Southgate, Yateley, England

[73] Assignee: Fieldtech Limited, England

[21] Appl. No.: 31,800

[22] Filed: Apr. 20, 1979

[30] Foreign Application Priority Data

Apr. 24, 1978 [GB] United Kingdom ..... 16132/78

[51] Int. Cl.[3] ..... G08B 3/00

[52] U.S. Cl. ..... 340/384 E; 340/384 R; 84/1.01

[58] Field of Search ..... 340/384 E, 384 R; 331/47; 84/1.01

[56] References Cited

U.S. PATENT DOCUMENTS

| | | | |
|---|---|---|---|
| 4,001,816 | 1/1977 | Yamada | 340/384 E |
| 4,012,702 | 3/1977 | Weber | 340/384 E |
| 4,110,750 | 8/1978 | Heyning | 340/384 R |

*Primary Examiner*—Harold I. Pitts

*Attorney, Agent, or Firm*—Pollock, Vande Sande & Priddy

[57] ABSTRACT

A circuit for generating an audio chime signal, for use on a passenger aircraft, for example to attract the attention of the passengers prior to a public announcement. High and low frequency oscillators are switched on for respective time periods, the low frequency oscillator being switched on after the high frequency oscillator. Decay circuitry causes a progressive decay in the output of each oscillator and a sine shaper removes harmonics of the high and low frequencies.

12 Claims, 2 Drawing Figures

AUDIO CHIME-SIGNAL GENERATING CIRCUIT

FIELD OF THE INVENTION

This invention relates to a circuit for generating an audio chime-signal, the chime being such as is used for example on passenger aircraft, helicopters, buses or boats to attach the attention of passengers before an announcement is made over a public address system.

Chime-signal generating circuits are known but are generally complex and sometimes liable to generate audio outputs of variable quality. Usually the circuit comprises four oscillators, and frequency modulation is employed to generate the required output chime, which ideally consists of a first note of high pitch followed by a second note of low pitch, with the two notes being free of harmonics.

SUMMARY OF THE INVENTION

This invention provides an audio chime-signal generating circuit, comprising two oscillators having respective high and low operating frequencies, timing circuitry for switching the oscillators on for respective periods of time, the low-frequency oscillator being switched on after the high frequency oscillator, decay circuitry for causing a progressive decay in the output of each oscillator over an end portion of the respective operating periods, and a sine shaping circuit through which the oscillator outputs are passed to remove harmonics of the high and low operating frequencies.

In an embodiment to be described herein, each oscillator comprises an operational amplifier connected to operate in oscillator mode. The timing circuitry comprises two timers, one for each of the two oscillators, and each timer comprises an operational amplifier connected to operate in a timing mode. The first timer, for the high frequency oscillator, is activated in response to a manual control switch, but the second timer, for the low frequency oscillator, is activated by the first timer. Means are provided for causing only the low frequency oscillator to operate, so that only the low pitch note is produced when this note alone is required to call the passengers' attention to a "fasten safety belts" sign, for example.

BRIEF DESCRIPTION OF THE DRAWING

Said embodiment of this invention will now be described, by way of example only, with reference to the accompanying drawing, the FIGS. 1A and 1B are a diagram of an audio chime-signal generating circuit in accordance with the invention.

DETAILED DESCRIPTION

Figure 1A:
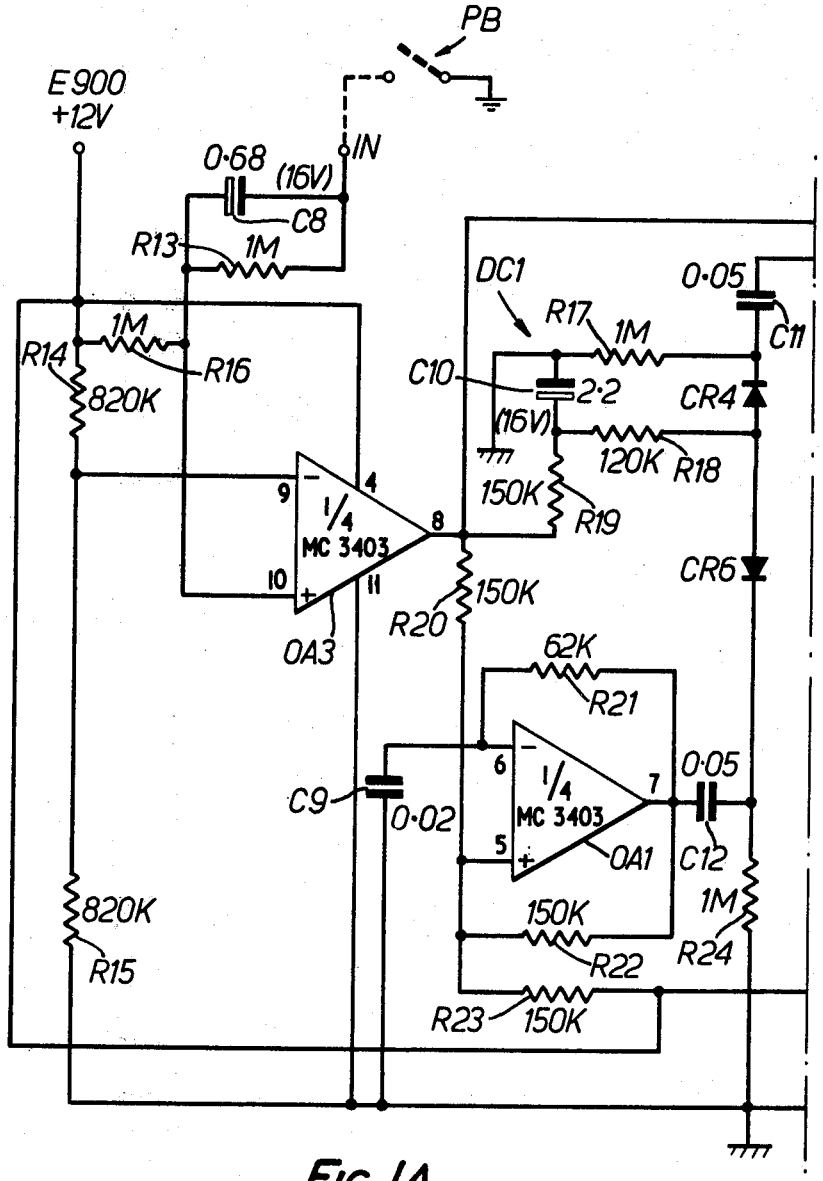
Figure 1B:
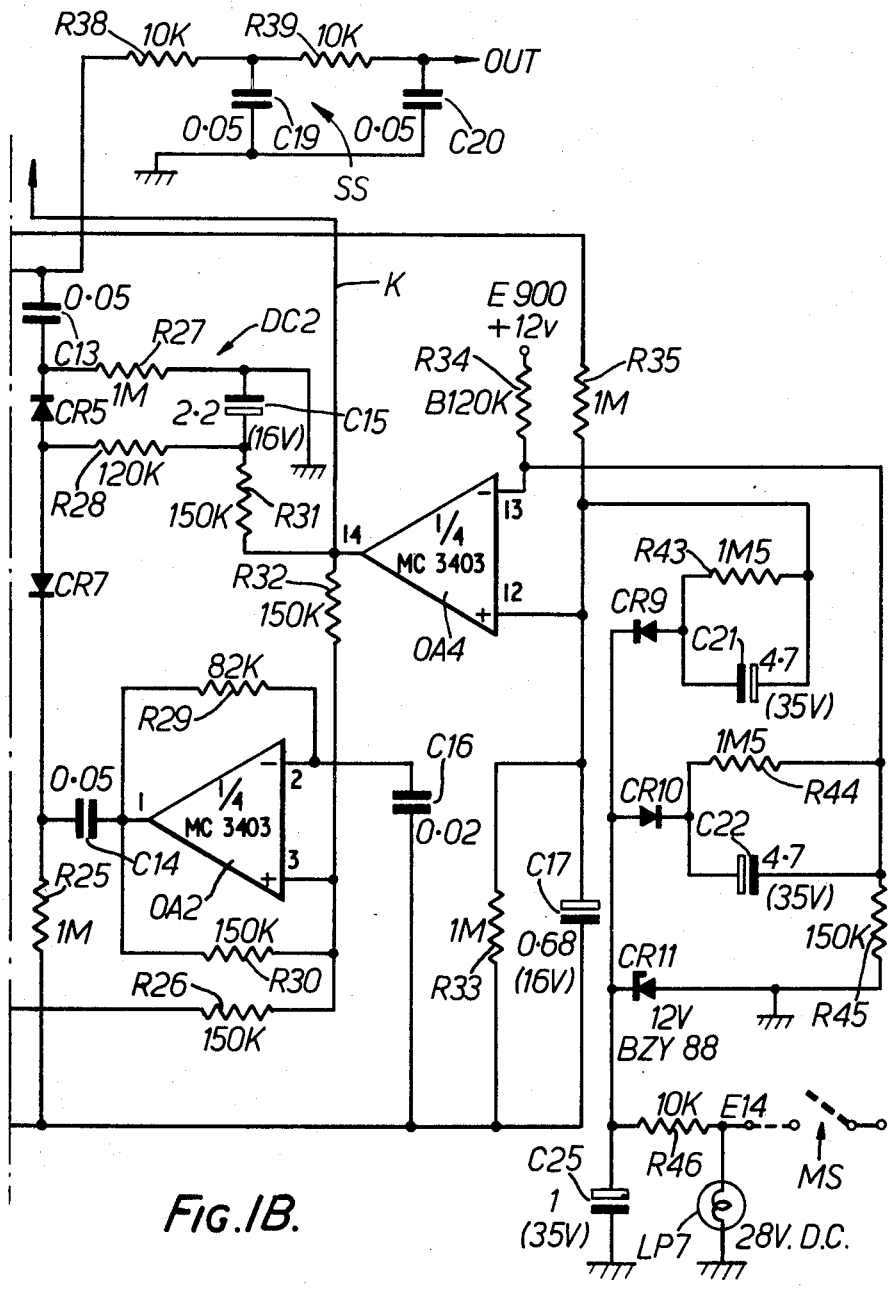

Referring to the drawing, the chime-signal generating circuit which is shown forms part of a combined passenger address and in-flight entertainment system for aircraft, particularly light aircraft, which is the subject of our co-pending patent application No. 31,801, filed April 20, 1979. The chime-signal generating circuit comprises two oscillators OA1 and OA2, each comprising an operational amplifier having external components connected to it to cause it to operate in oscillator mode. With the component values shown for positive feedback resistors R21, R29, OA1 has an oscillation frequency of about 800 Hz and OA2 has an oscillation frequency of about 500 Hz.

Respective timing circuits OA3 and OA4 are provided for the two oscillators, and each timing circuit comprises an operational amplifier connected to operate in the required timing mode. The four operational amplifiers OA1, OA2, OA3 and OA4 are all provided on a single integrated circuit marketed by Motorola Inc. under the designation Mc3403. The pin connections 1–14 of the integrated circuit are shown against the four operational amplifiers.

Considering the operational amplifier oscillator OA3, the inverting input is connected to the junction between resistors R14 and R15 which are connected in series between the positive 12 V supply and ground. A normally opencircuit input terminal IN is connected to the non-inverting input through a resistor R13 and capacitor C8 in parallel, a resistor R16 also connecting the non-inverting input to the +12 V supply.

The output 8 of osillator OA3 is connected through a resistor R20 to the non-inverting input of operational amplifier timer OA1, which input is returned to the +12 V supply through a resistor R23. A capacitor C9 is connected between the inverting input of timer OA1 and ground. Feedback resistors R21 and R22 connect the output 7 of oscillator OA1 to its inverting and non-inverting inputs, respectively.

Considering operational amplifier timer OA4, the inverting input is connected to the junction between resistors R34 and R45 which are connected in series between the +12 V supply and ground. The non-inverting input is connected to ground through a resistor R33 in parallel with a capacitor C17, and also through a resistor R35 to the output 8 of operational amplifier timer OA3.

The output 14 of timer OA4 is connected through a resistor R32 to the non-inverting input of oscillator OA2, which input is returned to the +12 V supply through a resistor R26. A capacitor C16 is connected between the inverting input of oscillator OA2 and ground. Feedback resistors R29 and R30 connect the output 1 to the inverting and non-inverting inputs, respectively. The outputs 7, 1 of the respective oscillators are coupled through respective capacitors C12, C14 and diodes CR6, CR7 in series to respective decay circuits DC1 and DC2. Resistors R24 and R25 return the junctions of the respective capacitor and diode connections C12, CR6 and C14, CR7 to ground.

Decay circuit DC1 comprises a series diode CR4, poled oppositely to diode CR6, with its pole (cathode) remote from diode CR6 connected to ground through a resistor R17 and its other pole (anode) connected to ground through a resistor R18 and capacitor C10 in series. The output 8 of timer OA3 is connected through a resistor R19 to the junction between the resistor R18 and capacitor C10.

Decay circuit DC2 is identical to decay circuit DC1 and will not be described in detail but reference to the drawing shows that it comprises components CR5, R27, R28, C15 and R31, resistor R31 being connected to the output 14 of timer OA4.

The decay circuit outputs are coupled through respective capacitors C11, C13 to a common point which is connected as input to a sine shaper SS, comprising a first series resistor R38 and shunt capacitor C19 and a second series resistor R39 and shunt capacitor C20.

It will be noted that the output of timer 14 is also supplied to a line K to perform a switching function in the combined passenger address and in-flight entertainment system which is described in detail in our co-pending application Ser. No. 31,801.

The chime-signal generating circuit also includes circuitry for causing generation of only the low pitch note when this is required. Thus, an input terminal E14 is normally connected either to ground or to +28 V but when the single, low pitch note is required it is connected to either +28 V or ground, respectively. The normal supply available in aircraft is +28 V, but the normal connection to E14 could be either ground or +28 V. An indicator lamp LP7 is connected between input E14 and ground and is positioned on the control panel. Input E14 is connected through a series resistor R46 to the anode and cathode, respectively, of diodes CR10 and CR9. The junction between resistor R46 and the diodes is connected to ground by a Zener CR11 and a capacitor C25 is connected between this junction and ground. The cathode of diode CR10 is connected through a resistor R44 and a capacitor C22 in parallel to the inverting input of timer OA4. The anode of diode CR9 is connected through a resistor R43 and a capacitor C21 in parallel to the non-inverting input of timer OA4.

In operation, in order to generate the twin-note chime, the normally open-circuit terminal IN is connected to ground as the result of operation of a manual switch PB, for example a push-to-talk button on a microphone to be used by a crew member to address the passengers. The normally "high" voltage level output at 8 of timer OA3 consequently goes to low level and remains low for a one second interval, as determined by capacitor C8 and resistor R13.

The low output at 8 enables the oscillator OA1 and its output oscillations (at about 800 Hz) to pass to the sine shaper SS through diodes CR6 and CR4. However, the decay circuit DC1 causes a progressive decay in the oscillations passed to the sine shaper SS and eventually (after about one-half second) reverse biases diodes CR6 and CR4 to terminate the oscillations allowed to pass to the sine shaper. Thus, normally the capacitor C10 has a high voltage on its positive plate, and this decays with time after the output at 8 of timer OA3 goes low, progressively attenuating the oscillations passing through diode CR6, until the voltage on capacitor C10 has fallen so low as to reverse bias diodes CR6 and CR4.

The initial fall of output 8 to its low level also takes the non-inverting input of second timer OA4 to a low level, but capacitor C17 and resistor R33 impose a one-half second delay before the output at 14 of timer OA4 switches to low from its normal high level. This low at 14 enables oscillator OA2 and its output oscillations (at about 500 Hz) to pass to the sine shaper SS through diodes CR7 and CR5. Decay circuit DC2 causes a progressive decay in the oscillations, operating in the same way as decay circuit DC2, the oscillations being terminated about ½ second after their onset by capacitor C15 reverse biasing diodes CR5 and CR7.

Accordingly, sine shaper SS receives, for a first one-half second, decaying high-frequency oscillations from oscillator OA1 and, for the next one-half second, decaying low-frequency oscillations from oscillator OA2. The sine shaper, being a low pass filter, is effective to remove the harmonics of the respective oscillator frequencies so that the output at OUT is a substantially pure, decaying sine wave for each of the high and low pitch notes.

At the end of one second from the initiation at terminal IN, the output at 8 of timer OA3 returns to high level, thus in any event disabling the two oscillations OA1 and OA2.

Generation of only the low pitch note, to accompany the illumination of a "Fasten seat belts" or "No smoking" sign, will now be described. Suppose that E14 is normally at ground and that the manual switch MS illuminating the sign has the effect of placing +28 V on E14. The indicator lamp LP7 is accordingly energized. The positive-going transition at E14 is limited to 12 V by the Zener CR11 and passes through diode CR10 and timing circuit C22, R44 to the inverting input of OA4. The effect is that the output at 14 of OA4 goes low for a one-half second period, causing the low pitch note to be generated by oscillator OA2 and decay circuit DC2 as previously described, but without triggering oscillator OA1 to produce the high pitch note.

If instead E14 is normally at +28 V and is then grounded by the manual switch, then lamp LP7 is normally energized but goes out. Also, the charge on capacitor C25 is normally limited to +12 V by Zener CR11 and the negativegoing transition passes through diode CR9 and timing circuit C21, R43 to the non-inverting input of OA4. This has the same effect as a positive-going transition applied to the inverting input 13, i.e., the output 14 goes low for one-half second to cause the low pitch note to be generated.

Turning off the illuminated sign returns E14 to its normal level and the transition re-activates the low pitch note.

It will be particularly noted that a large number of components, or chains of components, have a dual function, i.e., biasing and signal-carrying. Mention may be made of the output 8 of OA3 which is connected to the noninverting inputs 5 and 12 of OA1 and OA4 via R20 and R35. The outputs 8 and 14 of OA3 and OA4 are used both as biasing and signals controlling the decay circuits DC1 and DC2.

What is claimed is:

1. An audio chime-signal generating circuit, comprising (a) two oscillators having respective high and low operating frequencies;

(b) timing circuitry for switching on said oscillators for respective periods of time and for switching on the low-frequency oscillator after the high frequency oscillator;

(c) decay circuitry for causing progressive decay in the output of each oscillator over an end portion of the respective operating periods; and (d) a sine shaping circuit through which the oscillator outputs are passed to remove harmonics of the high and low operating frequencies.

2. A circuit as claimed in claim 1, in which said timing circuitry comprises a first timer the output of which changes voltage level in response to an initiation, said output being applied to said high frequency oscillator to enable the latter.

3. A circuit as claimed in claim 1, in which said timing circuitry comprises first and second timers, the output of said first timer changing voltage level in response to an initiation and said output of the second timer changing voltage level in response to and a predetermined interval after the change in level of the first timer output, the respective timer outputs being applied to said high and low frequency oscillators, respectively, to enable the latter.

4. A circuit as claimed in claim 3, in which said changes in output of said timers activates the respective decay circuits, each decay circuit being effective to terminate the passage of the respective oscillations to said sine shaper after a predetermined interval.

5. A circuit comprising two oscillators having respective high and low operating frequencies, timing circuitry for switching the oscillators on for respective periods of time and switching the low-frequency oscillator on after the high frequency oscillator, decay circuitry for causing a progressive decay in the output of each oscillator over an end portion of the respective operating periods, and a sine shaping circuit through which the oscillator outputs are passed to remove harmonics of the high and low operating frequencies, in which the timing circuitry comprises first and second timers, the output of said first timer changing voltage level in response to an initiation, and the output of said second timer changing voltage level in response to and a predetermined interval after the change in level of the first timer output, the respective timer outputs being applied to said high and low frequency oscillators, respectively, to enable the latter, in which said changes in output of the timers activate the respective decay circuits, each decay circuit being effective to terminate the passage of the respective oscillations to the sine shaper after a predetermined interval, and in which each decay circuit includes a series connection of a capacitor and resistor, said series connection shunting signal path from the respective oscillator to the sine shaper, the junction of said resistor and said capacitor being connected to the output of the respective timer.

6. A circuit as claimed in claim 5, in which a diode is provided in said signal path between said oscillator and said decay circuit and becomes reverse biased, to terminate the passage of oscillations, when said capacitor has reached a threshold level of charge after said change in level of the respective timer output.

7. A circuit as claimed in claim 5, in which a diode is provided in said signal path between said oscillator and said decay circuit and becomes reverse biased, to terminate the passage of oscillations, when said capacitor has reached a threshold level of charge after said change in level of the respective timer output, and in which a second diode is provided in said path, in reverse polarity to said first diode, between said sine shaper and the junction of said path with said series connection, a resistor shunting the output of said second diode and the second diode becoming reverse biased at the same time as the first diode.

8. A circuit as claimed in claims 3 or 5, in which each timer comprises an operational amplifier.

9. A circuit as claimed in claim 1 or 5, in which each oscillator comprises an operational amplifier.

10. A circuit as claimed in claim 1 or 5, further comprising means for activating said second oscillator only to provide a low pitch note alone.

11. A circuit as claimed in claim 5, further comprising means for activating the second oscillator only to provide a low pitch note alone, said means being effective, in response to initiation thereof, to a change an input of the said second timer so as to change the output level thereof and thereby activate said second oscillator.

12. A circuit as claimed in claim 11, in which said means is responsive to a positive-going transition at its input to apply this transition to one input of said second timer, and is responsive to a negativegoing transition at its input to apply such transition to another input of said second timer, said second timer comprising an operational amplifier.

* * * * *